United States Patent [19]

Treczka et al.

[11] 4,233,580

[45] Nov. 11, 1980

[54] ROTATING COUPLER FOR TRANSMITTING HIGH FREQUENCY ENERGY

[75] Inventors: Leo Treczka, Munich; Georg Spinner, Feldkirchen-Westerham, both of Fed. Rep. of Germany

[73] Assignee: Spinner GmbH, Munich, Fed. Rep. of Germany

[21] Appl. No.: 853,849

[22] Filed: Nov. 22, 1977

[30] Foreign Application Priority Data

Nov. 23, 1976 [DE] Fed. Rep. of Germany ..... 2653209
Nov. 23, 1976 [DE] Fed. Rep. of Germany ..... 2653210

[51] Int. Cl.[3] ..... H01P 1/06; H01P 7/06

[52] U.S. Cl. ..... 333/261; 333/27; 333/227; 333/230

[58] Field of Search ..... 333/98 TN, 98 S, 84 R, 333/84 M, 97 R, 97 S, 27, 260–261, 248, 254, 256–259, 227, 219, 222, 235, 230; 343/757, 766

[56] References Cited

U.S. PATENT DOCUMENTS 3,199,055 8/1965 Keen ..... 333/84M
3,914,715 10/1975 Hubing et al. ..... 333/98 TN X
4,117,426 9/1978 Hudspeth et al. ..... 333/257

FOREIGN PATENT DOCUMENTS 1896076 12/1974 U.S.S.R. ..... 333/98 TN

OTHER PUBLICATIONS

Fromm et al–"A New Microwave Rotary Joint" in 1958 IRE National Convention Record vol. 6; pp. 78–72.

Cohen–"A Six-Channel Vertically Stacked Coaxial Rotary Joint for the S–, C– and X–Band Region" in The Microwave Journal, Nov. 1964; pp. 71–74.

Wood–"Microwave Rotating Joints" in Electron. (GB) Mar. 13, 1975; pp. 49–50.

*Primary Examiner*—Marvin L. Nussbaum
*Attorney, Agent, or Firm*—Ostrolenk, Faber, Gerb & Soffen

[57] ABSTRACT

A rotary coupler of the non-contact type has folded resonant spaces when seen in radial section. A large central lead aperture may be provided.

18 Claims, 3 Drawing Figures

ROTATING COUPLER FOR TRANSMITTING HIGH FREQUENCY ENERGY

BACKGROUND AND SUMMARY OF THE INVENTION

The invention relates to rotating couplers for transmitting high frequency energy from a stationary to a rotating system and vice-versa. Such rotating couplers maybe of a wiping contact type or a non-contact type via transformer devices, which transform an apparent short-circuit at an air gap. The invention relates to such a non-contact rotating coupler.

The invention seeks to produce a non-contact rotating coupler with a large free inner passage suitable for transmitting several channels within a frequency range preferably larger than 500 MHz and at the same time providing; a small reflection coefficient, small variation of the reflection coefficient over the rotating range of 360°, small transit loss over the rotating range, small variation of the phase angle of the transmitted signal over the transit range, high attenuation of inductive distrubance between several rotating couplings, large band width of the transmission range, small dimensions, in particular small length in axial direction and small radial dimensions with a large free inner diameter.

According to the invention there is provided a rotating coupler based on the principle of the $\lambda/2$ resonant circuit for forming a multiple rotating coupler with a free inner space to allow the passing through of connection leads characterized in that the resonant spaces of the resonant circuit are folded. A compact construction is achieved by folding the conductor sections, which may be done in axial as well as in radial direction. The term "folding" is used herein to indicate the appearance of the section not its manner of production. Both the stationary and the rotary portions of the rotating coupler are equipped with a resonant structure, preferably a $\lambda/4$ resonator, whereby coupling of the resonators on both sides is effected conductively or directly for preference. Coupling of the two resonant circuits is conveniently effected by a capacitive load applied at the high-ohmic point.

According to the invention each rotating coupler may be designed as a structural modular unit. Due to the modular design it is possible to link as many rotating couplings in axial direction by screw or even flange connections as is necessary for a particular application.

In order to achieve good access to the coaxial feeders or leads in the form of coaxial cables from outside the coupler as well as from inside the coupler, the excitation from the stationary or the rotatable system is not related, as has been usual in the past, to the inner conductor, but to the outer conductor. This latter measure has the great advantage that there is a distance of approx. $\lambda/2$ between the coupling points, giving an extended transmission lead and thereby resulting in an attenuation of the unavoidable field interference at the coupling points to such an extent that the dependance of the electrical values upon the rotating angle of the rotating coupler becomes very negligible. This arrangement also makes it possible to build rotating couplers with an overall length of not more than approximately $\lambda/2$ —an advantage not possible with the previous designs —for a simple arrangement of the $\lambda/4$ transformer stages necessary for achieving a non-contact transition at the rotating point.

BRIEF DESCRIPTION OF THE DRAWINGS

The invention is particularly described with reference to the drawings in which.

DETAILED DESCRIPTION OF THE DRAWINS

Figure 1:
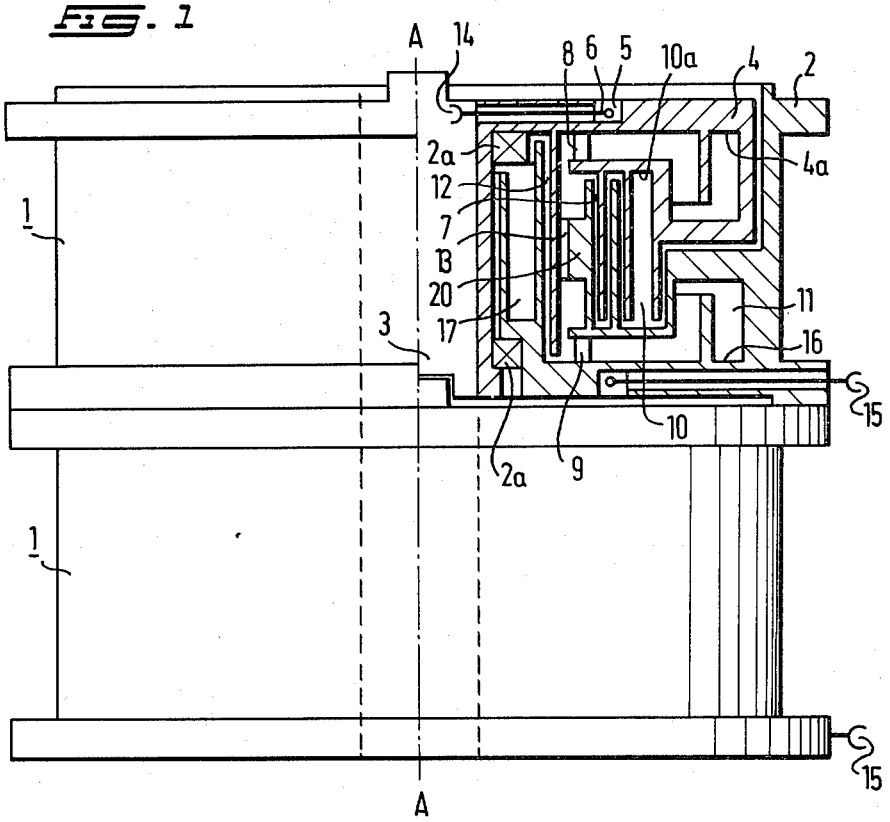
FIG. 1 is a partially sectioned view of one radially folded rotating coupler comprising a $\lambda/2$ resonant circuit of a pair of axially super-imposed individual rotating couplers according to the invention.

FIG. 1 shows two axially superimposed rotating couplers 1, each having an outer stator 2 and an inner rotor 4 supported by ball bearings 2*a*. An inner cavity 3 is formed concentrically with the rotating axis AA and permits the passage of jointly rotating leads which lead from the rotating aerials or similar parts to which the coupler 1 is connected to the rotor 4. In the example shown only two superimposed rotating couplers are provided. It is possible, however, to join as many rotating couplers as required, for instance seven or eight couplings arranged together in the axial direction, each with their rotors 4 rotating jointly. The connections 14 of the jointly rotating leads (passing through the inner space 3) and the stator leads 15 are each coupled to a quadruple distributor (not shown), the four outputs of which are connected to the coupling points. The four outputs have the same magnitude and phase values in order to suppress, as far as possible, the development of the $H_{11}$ -modes (waves) forming during the transmission. The stator and the rotor 4 are each folded several times, to form a resonant structure, preferably a $\lambda/4$ resonator. The resonators on both sides at 8 (rotor) or 9 (stator) are coupled ohmically. The necessary impedance-matching transformations of the HF transmission space are carried out in the quadruple distributor.

In order to maintain a small outer diameter, the invention provides for a folding of the frequency transmission space at the short-circuit end 4*a* (rotor) and 16 (stator). An electrical field is predominant at point 13, and a capacitive load is additionally applied at this point by means of a low-ohmic length of cable.

Furthermore the low-ohmic gap 7 between the rotor 4 and the stator 2 is folded several times between the HF-transmission space and the outer diameter, and it is of a length which corresponds to the length $\lambda/4$ of the mean transmission frequency. At the end, a short-circuited lead 10 is connected in series with a five times larger wave resistance, in order to keep the input resistance at the gap end 7 to the tramission space as low as possible, resulting in a transformed short-circuit at the gap, i.e. at the input to the resonator 11. The same applies to gap 12 which is filled with a dielectric in order to obtain the electric length $\lambda/4$ . This lead of the stator is also connected in series to a short-circuited lead 17 resulting in good attenuation to the outside.

Connections 14 and 15 lead radially to the iner and outer diameter respectively, and the coaxial leads as well as the distributors and the input leads are housed in recesses and drilled holes in the normal thicknesses of the walls. In this way it is possible to combine several rotating couplings to a multiple rotating coupling and achieve short constructional length.

Figure 2:
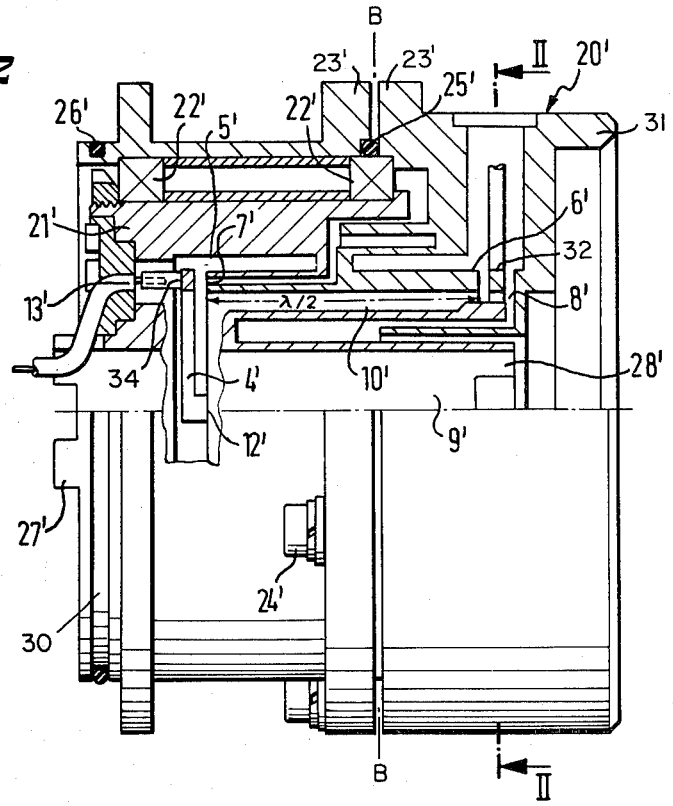
FIG. 2 is an axial half-sectional view of another coaxial rotating coupler according to the invention with axial folding.
Figure 3:
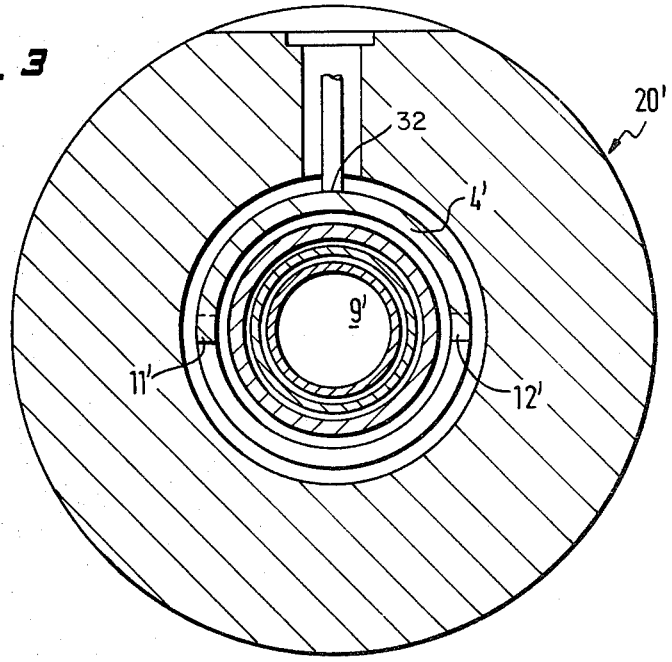
FIG. 3 is a section along line II—II of FIG. 2.

In the example according to FIGS. 2 and 3 each coupler 1 includes a stator 20' and a rotor 21', which are supported against each other both radially and axially by ball bearings 22'. The stator is divided radially along line B—B, with two flanges 23' located on either side of the dividing plane. A sealing ring 25' is located between the two flanges 23' which are coupled together by screws 24'. A further sealing ring 26' is located in an outer annular groove 30 at the front end of the stator 20', this groove forming a sealed connection with the sleeve flange 31 of the next rotating coupling element which can be pushed onto this section. The front part of rotor 21' is provided with axial coupling dogs 27' which engage corresponding dogs 28' of the next rotating coupling element forming a torsion-free connection. Inside the stator 20' is a concentric channel 9', carrying the coaxial leads 13' which are connected to the rotating aerials or similar parts to which the rotor 21' is coupled. Coupling inside the stator 20' is effected via a twofold distributor 32. Coupling inside the rotor 21' is effected via a towfold distributor 34. Distributors 32, 34 each have arms 4' (see FIG. 3) bent in the shape of a circle. The ends of the arms 4' form an ohmic contact with the stator 20' the rotor 21' respectively at two diametrically opposed points 11' and 12'.

Coupling and decoupling are effected via distributor circuits 32, 34 and coaxial conductors serve as extensions. The ends of the outside conductor are decoupled in the coupling plane 5; 6' from the surrounding housing by a $\lambda/4$ lead or conductor part which is short-circuited at the end.

At the cross-section planes 7', 8', which are spaced apart by $\lambda/2$, a short-circuit is almost transformed via the folded $\lambda/4$ lead with varying wave resistance for the envisaged operating range.

Any number of rotating coupler units as illustrated in FIGS. 1 or 2 may be axially combined to form a multiple rotating coupler column. Since all HF-coaxial leads of the individual couplings arranged in one rotational plane pass through the free inside diameter of the rotating couplings, this inside diameter is selected correspondingly large. From this follows that the transmission lead has to be operated above the limiting frequency to achieve a clear transmission of the TEM wave. This entails considerable interference by the $H_{11}$-wave, since this field type causes large variations of the electric transmission properties as a function of the rotation. Since the excitation points 11' and 12' have the same phase and are staggered by 180°, the $H_{11}$-wave is substantially supressed.

The distributors 1', 2' with their arms 4' may be produced as integral parts of the outside conductor. This will result in very little variation in the electric characteristics of the couplers for batch production, and no further supports are required thus reducing manufacturing costs. The outer input lead 13' to the distributors 1' and 2' may be connected with ease.

What we claim is:

1. A rotary coupler for coupling two relatively rotating circuits, said rotary coupler comprising:

first means defining a free inner space which permits connection leads to pass therethrough;

said rotary coupler having its rotational axis extending lengthwise through said iner space; and second means defining a resonant circuit disposed outside of said inner space and including folded resonant spaces, one of said folded resonant spaces being for energy transmission, and at least one of said folded resonant spaces being equal to between one-fourth and one-half, inclusive, of the principal wavelength to be transmitted via said rotary coupler.

2. A rotary coupler according to claim 1 in which said resonant spaces are defined by conductor parts extending radially with respect to said rotational axis.

3. A rotary coupler according to claim 1 in which there is a relatively high coupling capacity at a gap between first and second ones of said resonant spaces.

4. A rotary coupler according to claim 3, in which said coupling capacity is formed by sleeve-like interpenetrating axial conductor sections of a rotor and a stator.

5. A rotary coupler according to claim 1, in which said resonant spaces define a $\lambda/2$ resonator with a short-circuit.

6. A rotary coupler according to claim 5, in which said resonant circuit has a plane of symmetry and in which a capacitive load is applied at a point of said resonant circuit on said plane of symmetry.

7. A rotary coupler according to claim 6, in which said resonant circuit has first and second coupling points and in which said capacitive load is arranged so as to shield said first and second coupling points.

8. A rotary coupler according to claim 6, in which said capacitive load is dimensioned so as to suppress field interferences.

9. A rotary coupler according to claim 1 further comprising a plurality of coupling and decoupling points distributed circumferentially and each of which is connected to one of said resonant spaces.

10. A rotary coupler according to claim 9, in which, said coupling points connected to a distributor means the outputs of which correspond to the number of coupling points.

11. A rotary coupler according to claim 9 in which said coupling points are at least four in number and further comprising a co-axial multiple connection at each of said at least four coupling points constructed to produce the same amplitude and same phase at each of said at least four coupling points.

12. A rotary coupler according to claim 9 in which coupling at said coupling points is effected via quarter- to semi-rings which form part of a distributor means and an impedance-matching transformer.

13. A rotary coupler according to claim 1 in which said second means defines a high frequency transmission space having an inner and an outer diameter, said transmission space being folded and short circuited and being folded at its said outer diameter and being provided with a capacitive load at its said inner diameter by means of low-ohmic wave resistances.

14. A rotary coupler according to claim 13 in which said high frequency transmission space further comprises first and second rotating elements, and in which there is an outer low-ohmic gap between said first and second rotating elements.

15. A rotary coupler according to claim 1, further comprising mechanical coupling elements for mechanically coupling respective rotatable parts of several of said rotary couplers to be coupled to each other.

16. A rotary coupler according to claim 15, constructed for combination structurally with another of such couplers, each of said couplers having complementary front and rear connection formations for a stator and a rotor of said couplers, said couplers being connected with input and output coupling points arranged at a distance of approximately $\lambda/2$.

17. A rotary coupler according to claim 16 in which the coupling or decoupling at said rotor and stator is effected at diametrically opposed points.

18. A rotary coupler according to claim 1 in which said resonant spaces are defined by conductor parts extending axially with respect to said rotational axis.

* * * * *